US009364879B2

(12) United States Patent
Shimoi et al.

(10) Patent No.: US 9,364,879 B2
(45) Date of Patent: Jun. 14, 2016

(54) COOLING CONTROL METHOD, COOLING CONTROL APPARATUS, AND COOLING WATER AMOUNT CALCULATION APPARATUS

(75) Inventors: Shinichiroh Shimoi, Tokyo (JP); Hironori Ueno, Tokyo (JP); Yoshihiko Himuro, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1079 days.

(21) Appl. No.: 12/087,686

(22) PCT Filed: Jul. 19, 2007

(86) PCT No.: PCT/JP2007/064618

§ 371 (c)(1),
(2), (4) Date: Jul. 10, 2008

(87) PCT Pub. No.: WO2009/011070

PCT Pub. Date: Jan. 22, 2009

(65) Prior Publication Data

US 2010/0219566 A1 Sep. 2, 2010

(51) Int. Cl.
*C21D 1/00* (2006.01)
*B21B 37/76* (2006.01)
(Continued)

(52) U.S. Cl.
CPC ..... *B21B 37/76* (2013.01); *C21D 1/667* (2013.01); *C21D 11/005* (2013.01); *B21B 45/0218* (2013.01)

(58) Field of Classification Search
CPC .. B21B 37/76; B21B 45/0218; C21D 11/005; C21D 1/667
USPC ..... 266/44, 46, 102, 111, 113, 88, 130; 72/201; 239/549, 550, 551
See application file for complete search history.

(56) References Cited

U.S. PATENT DOCUMENTS 4,047,985 A * 9/1977 Greenberger ..... 134/15
4,596,615 A * 6/1986 Matsuzaki et al. ..... 148/503
(Continued)

FOREIGN PATENT DOCUMENTS

CN 1425076 6/2003
CN 1640575 7/2005
(Continued)

OTHER PUBLICATIONS

Taiwan Office Action, dated Jul. 14, 2009, issued in corresponding Taiwan Application No. 096126342.
(Continued)

*Primary Examiner* — Scott Kastler
*Assistant Examiner* — Michael Aboagye
(74) *Attorney, Agent, or Firm* — Kenyon & Kenyon LLP

(57) ABSTRACT

The present invention provides a cooling control method which comprises calculating cooling conditions required for cooling the steel plate to a predetermined temperature for a plurality of positions inside a cooling apparatus based on measured temperatures at a time when the steel plate passes through the cooling apparatus by a thermometer disposed at the entry-side of the cooling apparatus and setting a cooling schedule, calculating a heat transfer coefficient from the set temperature and a cooling water density for cooling one surface of the steel plate, calculating a cooling top water density from the calculated heat transfer coefficient, and controlling the amounts of cooling water of the cooling apparatus based on the ratio of the cooling bottom water density and cooling top water density so as to cool the steel plate to a predetermined cooling end temperature.

8 Claims, 10 Drawing Sheets

(51) Int. Cl.

| | |
|---|---|
| ***C21D 1/667*** | (2006.01) |
| ***C21D 11/00*** | (2006.01) |
| *B21B 45/02* | (2006.01) |

(56) References Cited

U.S. PATENT DOCUMENTS

| | | | | | |
|---|---|---|---|---|---|
| 4,785,646 | A | * | 11/1988 | Uekaji et al. | 72/8.5 |
| 4,786,338 | A | * | 11/1988 | Anzawa et al. | 148/504 |
| 5,289,867 | A | * | 3/1994 | Barker et al. | 164/455 |
| 6,264,767 | B1 | * | 7/2001 | Frank et al. | 148/547 |
| 6,860,950 | B2 | | 3/2005 | Franz et al. | |
| 2003/0089431 | A1 | | 5/2003 | Gramckow et al. | |

FOREIGN PATENT DOCUMENTS

| | | | | |
|---|---|---|---|---|
| JP | 60-174834 | | 9/1985 | |
| JP | 60-210313 | | 10/1985 | |
| JP | 61-219412 | | 9/1986 | |
| JP | 2-70018 | | 3/1990 | |
| JP | 02-070018 | * | 3/1990 | C21D 8/02 |
| JP | 2-070018 | | 3/1990 | |
| JP | 02-179825 | | 7/1990 | |
| JP | 02-179827 | | 7/1990 | |
| JP | 04-232214 | | 8/1992 | |
| JP | 04-339511 | | 11/1992 | |
| JP | 7-029139 | | 4/1995 | |
| JP | 7-041303 | | 5/1995 | |
| JP | 07-0614983 | | 7/1995 | |
| JP | 2001-300628 | | 10/2001 | |
| JP | 2002-137013 | | 5/2002 | |
| JP | 2004-244721 | | 9/2004 | |
| JP | 2007-190597 | | 8/2007 | |
| RU | 2 067 904 | | 10/1996 | |
| RU | 2 183 522 | | 6/2002 | |
| SU | 1030060 | | 7/1983 | |
| SU | 1297960 | | 3/1987 | |
| SU | 1435348 | | 11/1988 | |

OTHER PUBLICATIONS

Russian Decision of Grant and Patent Publication issued in corresponding Russian Application No. 2008129256.

Korean Decision of Grant issued in corresponding Korean Application No. 10-2008-7017272.

Russian Office Action dated Feb. 1, 2010 issued in corresponding Russian Application No. 2008129256/02 (036166), with English Translation.

European Search Report dated Apr. 6, 2010 issued in corresponding European Application No. 07 76 8472.

* cited by examiner

COOLING CONTROL METHOD, COOLING CONTROL APPARATUS, AND COOLING WATER AMOUNT CALCULATION APPARATUS

BACKGROUND OF THE INVENTION

1. Field of the Invention

The present invention relates to a cooling control method, a cooling control apparatus, a cooling water amount calculation apparatus, a computer program, and a storage medium in a process of production of steel plate, more particularly relates to technology preferred for use for cooling steel plate immediately after rolling.

2. Description of the Related Art

Conventionally, cooling control designed to measure the temperature of the steel plate during cooled processing, change the amounts of cooling water sprayed on a top surface and a bottom surface of the steel plate so that a cooling end temperature becomes a desired temperature, and eliminating a difference between a top surface temperature and a bottom surface temperature of the steel plate so as to prevent shape deterioration of the steel plate occurring due to the difference between the top surface temperature and the bottom surface temperature of the steel plate has been proposed (see for example Japanese Patent Publication (B2) No. 7-41303).

Further, in the cooling method disclosed in Japanese Patent Publication (A) No. 60-210313, a top/bottom ratio of amounts of cooling water is determined by a coefficient determined from the size etc. of the cooled material. The steel plate temperature during cooling largely depends upon the amounts of cooling water and heat transfer coefficient. Namely, the heat transfer coefficient is a function of the surface temperature of the steel plate.

Accordingly, the state of the steel plate temperature at the time of the start of cooling, which differs for each cooling target, and the change of the heat transfer coefficient due to the change of the surface temperature of the steel plate during cooling, which changes with each instant, cannot be correctly reflected in the amounts of the cooling water. For this reason, deterioration of the shape of the steel plate could not be prevented with a high precision by just determining the top/bottom ratio of the amounts of water.

In order to solve the problem described before, the cooling method disclosed in Japanese Patent Publication (B2) No. 7-29139 predicts the temperature at the time of the cooling start based on the temperature at the time of the rolling end and calculates continuously changing surface temperature state and heat transfer coefficient by using a heat transfer formula using the predicted temperatures as the initial state so as to determine the water top/bottom ratio suppressing the deterioration of shape of the steel plate during cooling with a high precision.

However, as explained before, the heat transfer coefficient exerts a large influence upon the steel plate temperature at the time of the cooling start, therefore the cooling method disclosed in Japanese Patent Publication (B2) No. 7-29139 predicated on predicting the cooling start temperature at the time of the rolling end is susceptible to a variety of disturbances in the period from the rolling end to the cooling start. For this reason, the water top/bottom ratio determined at the time of the rolling end also includes a large amount of error, therefore the cooling method disclosed in Japanese Patent Publication (B2) No. 7-29139 had the problem that there was a limit to the suppression of shape deterioration of steel plate.

Therefore, as a technique for simultaneously solving the problems of the cooling methods disclosed in Japanese Patent Publication (A) No. 60-210313 and Japanese Patent Publication (B2) No. 7-29139, for example, in the cooling method disclosed in Japanese Patent Publication (A) No. 2-70018, the cooling top/bottom water rate ratio is calculated according to the temperatures measured at the cooling start position and the water top/bottom ratio giving a constant top/bottom temperature distribution is searched for and calculated by using a heat transfer formula considering the continuously changing surface temperature state and heat transfer coefficient.

In the case of the cooling method disclosed in Japanese Patent Publication (A) No. 2-70018 explained before, it is believed that the water top/bottom ratio can be found with a high precision. However, in the case of this cooling method, the heat transfer formula is used for repeated calculation to search for the top/bottom ratio of the amounts of cooling water, therefore the amount of calculation becomes huge. For this reason, there was the problem that tremendous time was needed until obtaining the results of calculation. As a result, there is a great possibility of the occurrence of the trouble of a delayed start of spraying of water after the steel plate enters the cooling apparatus, the trouble of the steel plate having to be stopped and kept on standby before the cooling apparatus until the water starts to be sprayed, etc., therefore the implementation was difficult.

SUMMARY OF THE INVENTION

In view of the above problems, an object of the present invention is to quickly control the amounts of cooling water sprayed from top and bottom surfaces of the cooling apparatus when cooling steel plate to a predetermined cooling end temperature so as to prevent shape deterioration of steel plate occurring due to the difference of cooling rates between the top surface and the bottom surface with a high precision.

The present invention was made so as to solve the above problem and has as its gist the following:

(1) A cooling control method for cooling steel plate by a cooling apparatus immediately after rolling, comprising:

a cooling schedule setting step of calculating cooling conditions required for cooling the steel plate to a predetermined temperature for a plurality of positions inside the cooling apparatus based on the measured temperatures at a time when the steel plate passes through the cooling apparatus by a thermometer disposed at the entry-side of the cooling apparatus and setting the cooling schedule;

a heat transfer coefficient calculation step calculating a heat transfer coefficient showing an ease of conduction of heat from the temperature in the scheduled cooling set by the scheduled cooling setting step and the first cooling water density in cooling water for cooling one surface of the steel plate;

a top/bottom ratio calculation step of calculating the second cooling water density in the cooling water for cooling an opposite surface of the steel plate from the heat transfer coefficient calculated by the heat transfer coefficient calculation step and calculating the top/bottom ratio between the first cooling water density and the second cooling water density; and a cooling water amount controlling step of controlling the amounts of cooling water for cooling the steel plate passing through the cooling apparatus based on the top/bottom ratio calculated by the top/bottom ratio calculation step.

(2) A cooling control method as set forth in (1), wherein:

the first cooling water density is the cooling water density of the cooling water for cooling a bottom surface of the steel plate, and the second cooling water density is the cooling water density of the cooling water for cooling a top surface of the steel plate.

(3) A cooling control method as set forth in (1) or (2), wherein the top/bottom ratio calculation step calculates top/bottom ratios of cooling water densities at a plurality of positions inside the cooling apparatus based on the cooling schedule set by the cooling schedule setting step.

(4) A cooling control method as set forth in any one of (1) to (3), wherein the first cooling water density is determined based on the cooling schedule set by the cooling schedule setting step.

(5) A cooling control apparatus for cooling steel plate by a cooling apparatus immediately after rolling, comprising:

a cooling schedule setting means for calculating cooling conditions required for cooling the steel plate to a predetermined temperature for a plurality of positions inside the cooling apparatus based on measured temperatures at a time when the steel plate passes through the cooling apparatus by a thermometer disposed at the entry-side of the cooling apparatus and setting a cooling schedule;

a heat transfer coefficient calculating means for calculating a heat transfer coefficient showing an ease of conduction of heat from the temperature in the cooling schedule set by the cooling schedule setting means and a first cooling water density in cooling water for cooling one surface of the steel plate;

a top/bottom ratio calculating means for calculating a second cooling water density in the cooling water for cooling an opposite surface of the steel plate from the heat transfer coefficient calculated by the heat transfer coefficient calculating means and calculating the top/bottom ratio between the first cooling water density and, the second cooling water density; and a cooling water amount controlling means for controlling the amounts of cooling water for cooling the steel plate passing through the cooling apparatus based on the top/bottom ratio calculated by the top/bottom ratio calculating means.

(6) A cooling control apparatus as set forth in (5), wherein:

the first cooling water density is the cooling water density of the cooling water for cooling a bottom surface of the steel plate, and the second cooling water density is the cooling water density of the cooling water for cooling a top surface of the steel plate.

(7) A cooling control apparatus as set forth in (5) or (6), wherein the top/bottom ratio calculating means is for calculating top/bottom ratios of cooling water densities at a plurality of positions inside the cooling apparatus based on the cooling schedule set by the cooling schedule setting means.

(8) A cooling control apparatus as set forth in any one of (5) to (7), wherein the first cooling water density is determined based on the cooling schedule set by the cooling schedule setting means.

(9) A cooling water amount calculation apparatus for calculating amounts of cooling water required for cooling steel plate by a cooling apparatus immediately after rolling, comprising:

a cooling schedule setting means for calculating cooling conditions required for cooling the steel plate to a predetermined temperature for a plurality of positions inside the cooling apparatus based on measured temperatures at a time when the steel plate passes through the cooling apparatus by a thermometer disposed at an entry-side of the cooling apparatus and setting a cooling schedule;

a heat transfer coefficient calculating means for calculating a heat transfer coefficient showing an ease of conduction of heat from the temperature in the cooling schedule set by the cooling schedule setting means and the first cooling water density in cooling water for cooling one surface of the steel plate; and a top/bottom ratio calculating means for calculating a second cooling water density in the cooling water for cooling an opposite surface of the steel plate from the heat transfer coefficient calculated by the heat transfer coefficient calculating means and calculating the top/bottom ratio between the first cooling water density and the second cooling water density.

(10) A computer program characterized in that the computer is made execute the cooling control method disclosed in any one of (1) to (4).

(11) A storage medium readable by a computer characterized in that it stores the computer program disclosed in (10).

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
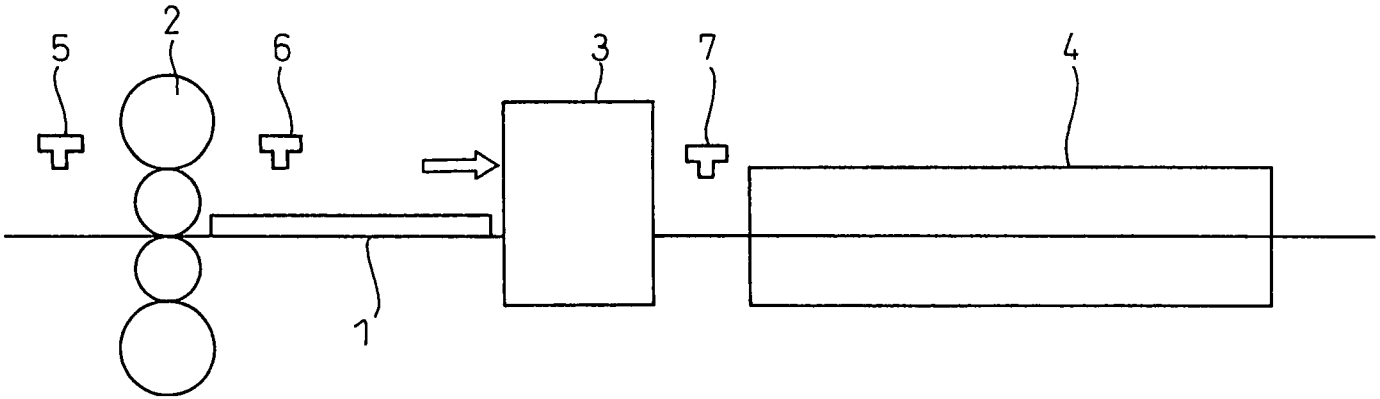
FIG. 1 is a view showing an example of a steel plate production line in a first embodiment of the present invention.

The cooling control method of the present invention is a cooling control method for cooling steel plate by a cooling apparatus immediately after rolling, comprising a cooling schedule setting step of calculating cooling conditions required for cooling the steel plate to a predetermined temperature for a plurality of positions inside the cooling apparatus based on measured temperatures at a time when the steel plate passes through the cooling apparatus by a thermometer disposed at the entry-side of the cooling apparatus and setting a cooling schedule; a heat transfer coefficient calculation step of calculating a heat transfer coefficient showing an ease of conduction of heat from the temperature in the cooling schedule set by the cooling schedule setting step and the first cooling water density in cooling water for cooling one surface of the steel plate; a top/bottom ratio calculation step of calculating the second cooling water density in the cooling water for cooling an opposite surface of the steel plate from the heat transfer coefficient calculated by the heat transfer coefficient calculation step and calculating the top/bottom ratio between the first cooling water density and the second cooling water density; and a cooling water amount controlling step of controlling the amounts of cooling water for cooling the steel plate passing through the cooling apparatus based on the top/bottom ratio calculated by the top/bottom ratio calculation step.

The cooling control apparatus of the present invention is a cooling control apparatus for cooling steel plate by a cooling apparatus immediately after rolling, comprising a cooling schedule setting means for calculating cooling conditions required for cooling the steel plate to a predetermined temperature for a plurality of positions inside the cooling apparatus based on measured temperatures at a time when the steel plate passes through the cooling apparatus by a thermometer disposed at the entry-side of the cooling apparatus and setting a cooling schedule; a heat transfer coefficient calculating means for calculating a heat transfer coefficient showing an ease of conduction of heat from the temperature in the cooling schedule set by the cooling schedule setting means and a first cooling water density in cooling water for cooling one surface of the steel plate; a top/bottom ratio calculating means for calculating a second cooling water density in the cooling water for cooling an opposite surface of the steel plate from the heat transfer coefficient calculated by the heat transfer coefficient calculating means and calculating the top/bottom ratio between the first cooling water density and the second cooling water density; and a cooling water amount controlling means for controlling the amounts of cooling water for cooling the steel plate passing through the cooling apparatus based on the top/bottom ratio calculated by the top/bottom ratio calculating means.

The cooling water amount calculation apparatus of the present invention is a cooling water amount calculation apparatus for calculating amounts of cooling water required for cooling steel plate by a cooling apparatus immediately after rolling, comprising a cooling schedule setting means for calculating cooling conditions required for cooling the steel plate to a predetermined temperature for a plurality of positions inside the cooling apparatus based on measured temperatures at a time when the steel plate passes through the cooling apparatus by a thermometer disposed at the entry-side of the cooling apparatus and setting a cooling schedule; a heat transfer coefficient calculating means for calculating a heat transfer coefficient showing an ease of conduction of heat from the temperature in the cooling schedule set by the cooling schedule setting means and a first cooling water density in cooling water for cooling one surface of the steel plate; and a top/bottom ratio calculating means for calculating a second cooling water density in the cooling water for cooling an opposite surface of the steel plate from the heat transfer coefficient calculated by the heat transfer coefficient calculating means and calculating the top/bottom ratio between the first cooling water density and the second cooling water density.

The computer program of the present invention is characterized in that the computer is made to execute the cooling control method disclosed before.

The storage medium of the present invention is characterized in that the computer program disclosed above is stored.

According to the present invention, cooling conditions required until the steel plate is cooled to the predetermined temperature are calculated for a plurality of positions inside the cooling apparatus based on the measurement values of the temperatures when the steel plate passes through the inside of the cooling apparatus by a thermometer disposed at the entry-side of the cooling apparatus and the cooling schedule is set, a heat transfer coefficient showing the ease of the conduction of the heat is calculated from the temperature in the set scheduled cooling schedule and the first cooling water density in the cooling water for cooling one surface of the steel plate, the second cooling water density in the cooling water for cooling the opposite surface of the steel plate is calculated from the calculated heat transfer coefficient, and the amount of the cooling water for cooling the steel plate passing through the cooling apparatus is controlled based on the top/bottom ratio between the first cooling water density and the second cooling water density, therefore the calculation amount required for controlling the amounts of cooling water sprayed from the top and bottom surfaces of the cooling apparatus to cool the steel plate to the predetermined cooling end temperature can be simplified. Due to this, the time until the required calculation results are obtained can be greatly shortened, therefore the period from when the temperature of the steel plate is measured to when the cooling is actually started can be greatly shortened. Accordingly, it becomes possible to dispose the entry-side thermometer just in front of the cooling apparatus, cooling with little difference of the top/bottom ratio of the amounts of water can be realized, and deterioration of the steel plate shape can be suppressed.

First Embodiment

Below, preferred embodiments of the present invention will be explained with reference to the attached drawings.

FIG. 1 shows an example of a steel plate production line to which the present invention is applied.

As shown in FIG. 1, a finish rolling mill 2 for rolling steel plate 1 roughly formed by passing through a not shown heating furnace or rough rolling mill down to a target plate thickness, a straightener 3 for straightening the shape of the steel plate 1 after the finish rolling, and a cooling apparatus 4 for acceleratedly cooling the steel plate 1 are successively arranged. The accelerated cooled steel plate 1 becomes a product of the desired shape and quality.

A final entry-side thermometer 5 is arranged at the entry-side of the finish rolling mill 2, while a final exit-side thermometer 6 is arranged at the exit side. Further, a cooling entry-side thermometer 7 is arranged at the entry-side of the cooling apparatus 4. In the present embodiment, the thermometers can measure the temperatures of the top surface and bottom surface of the steel plate 1.

Figure 2:
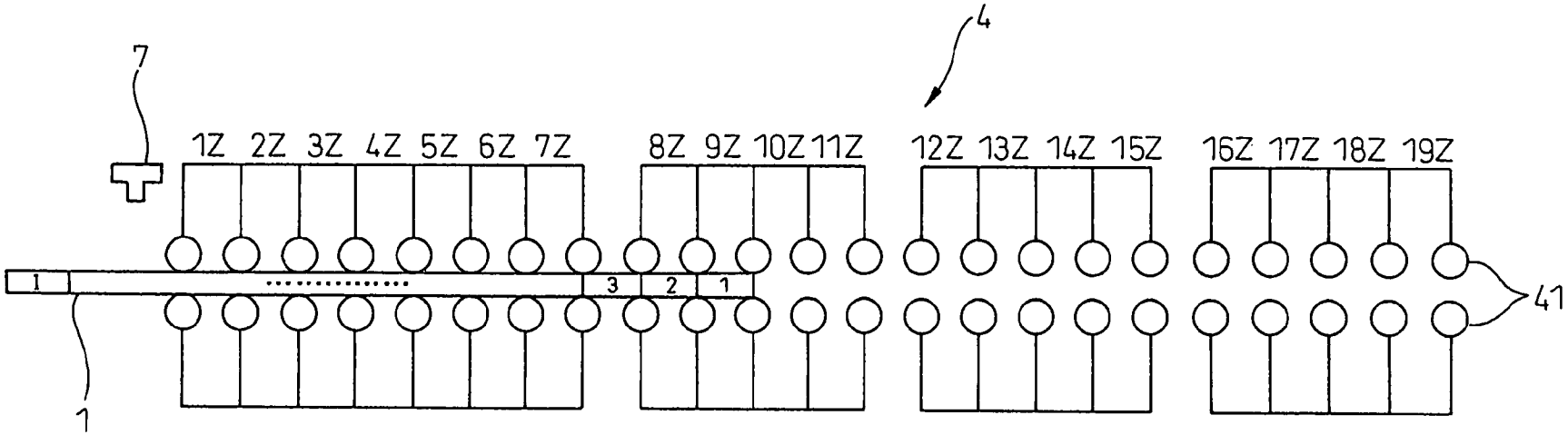
FIG. 2 is a view showing an example of the internal configuration of a cooling apparatus in the first embodiment of the present invention.

FIG. 2 is a view showing an example of the internal configuration of the cooling apparatus 4. Inside the cooling apparatus 4, a large number of groups of rollers 41 conveying the steel plate 1 are arranged and a large number of groups of nozzles (not shown) spraying cooling water to the top surface and bottom surface of the steel plate 1 are arranged in the cooling zones 1Z to 19Z. The sprays of the cooling water from these groups of nozzles are controlled by the flow rate control valves. The number of usage zones and the amounts of spray from the nozzles can be adjusted by the plate thickness or plate length of the steel plate and other conditions. In the present embodiment, the cooling entry-side thermometer 7 is arranged at the entry-side of the cooling apparatus 4.

Figure 3:
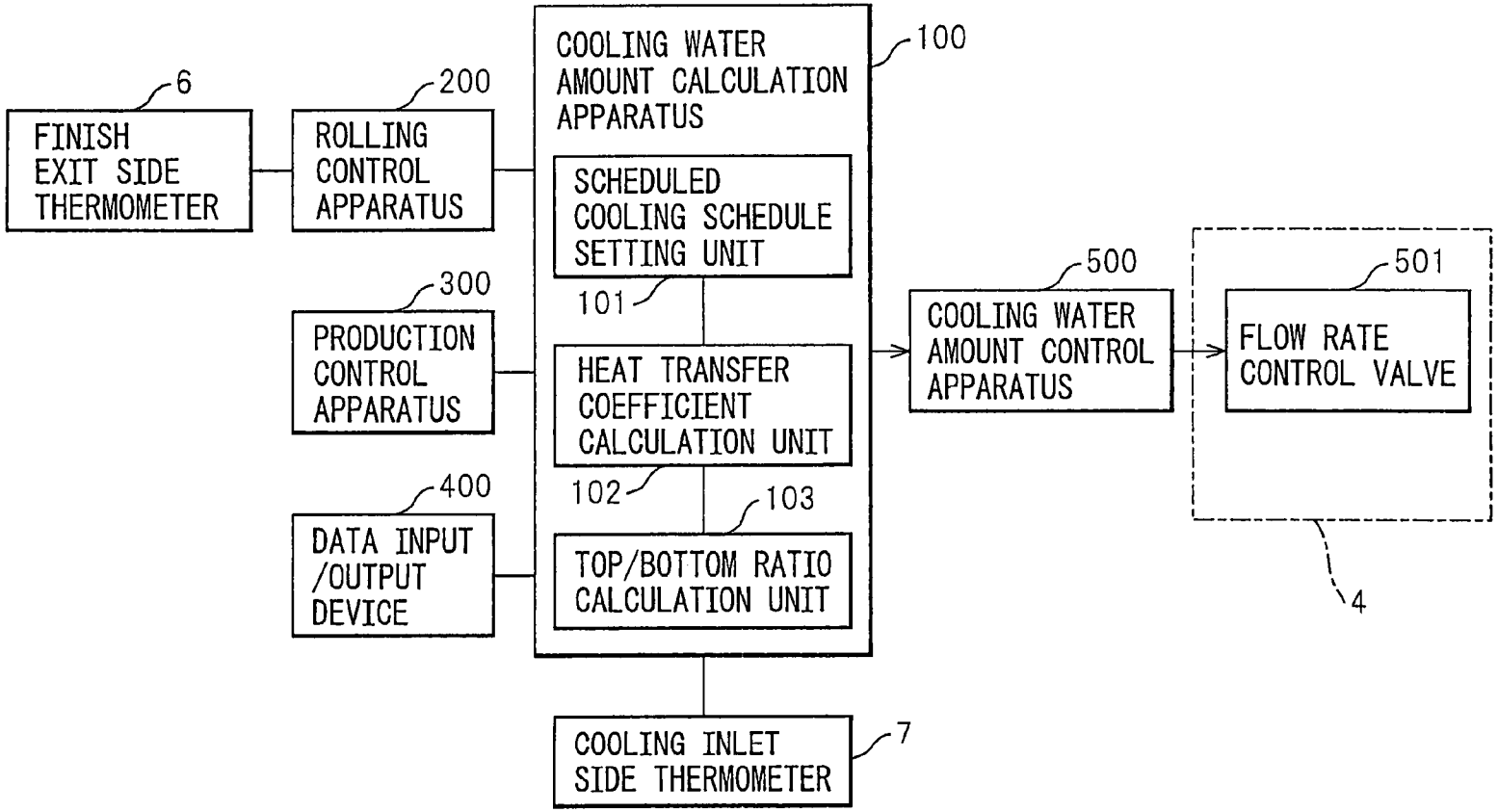
FIG. 3 is a block diagram showing a schematic example of the configuration of a control system including a cooling water amount calculation apparatus in the first embodiment of the present invention.

FIG. 3 is a block diagram showing the schematic configuration of a control system including a cooling water amount calculation apparatus 100 of the present embodiment. The cooling water amount calculation apparatus 100 has a rolling control apparatus 200 for overall control of the rolling mills including the finish rolling mill 2, a production control apparatus 300 mainly production control, a data input/output device 400 displaying various types of data output from the cooling water amount calculation apparatus 100 and outputting the input from the operator to the cooling water amount calculation apparatus 100, and a cooling inlet side thermometer 7 connected to it.

Further, the cooling water amount calculation apparatus 100 has a cooling water amount control apparatus 500 for controlling flow rate control valves 501 in cooling zones 1Z to 19Z of the cooling apparatus 4 to control the amounts of cooling water rates connected to it.

Namely, the cooling water amount calculation apparatus 100 calculates the amounts of cooling water controlled by the cooling water control apparatus 500 based on the data input from the cooling entry-side thermometer 7, the rolling control apparatus 200, the production control apparatus 300, the data input/output device 400, etc.

In particular, the cooling water amount calculation apparatus 100 of the present embodiment determines the amounts of the sprayed water of the cooling apparatus 4 by transmitting the data concerning the required amounts of cooling water to the cooling water amount control apparatus 500 while conveying the steel plate 1 after the finishing.

More specifically, the cooling water amount calculation apparatus 100 of the present embodiment is provided with a cooling schedule setting unit 101 for setting the cooling schedule of the steel plate 1 by the cooling apparatus 4 in accordance with target cooling end temperature information, a heat transfer coefficient calculation unit 102 for acquiring the heat transfer coefficient at a predetermined part of the steel plate 1 at the entry-side of the cooling apparatus 4, and a top/bottom ratio calculation unit 103 for calculating the water density ratio of the top surface and bottom surface reflected in the cooling water amount control apparatus 500 based on the cooling schedule set by the cooling schedule setting unit 101 and the heat transfer coefficient acquired by the heat transfer coefficient calculation unit 102.

Figure 4:
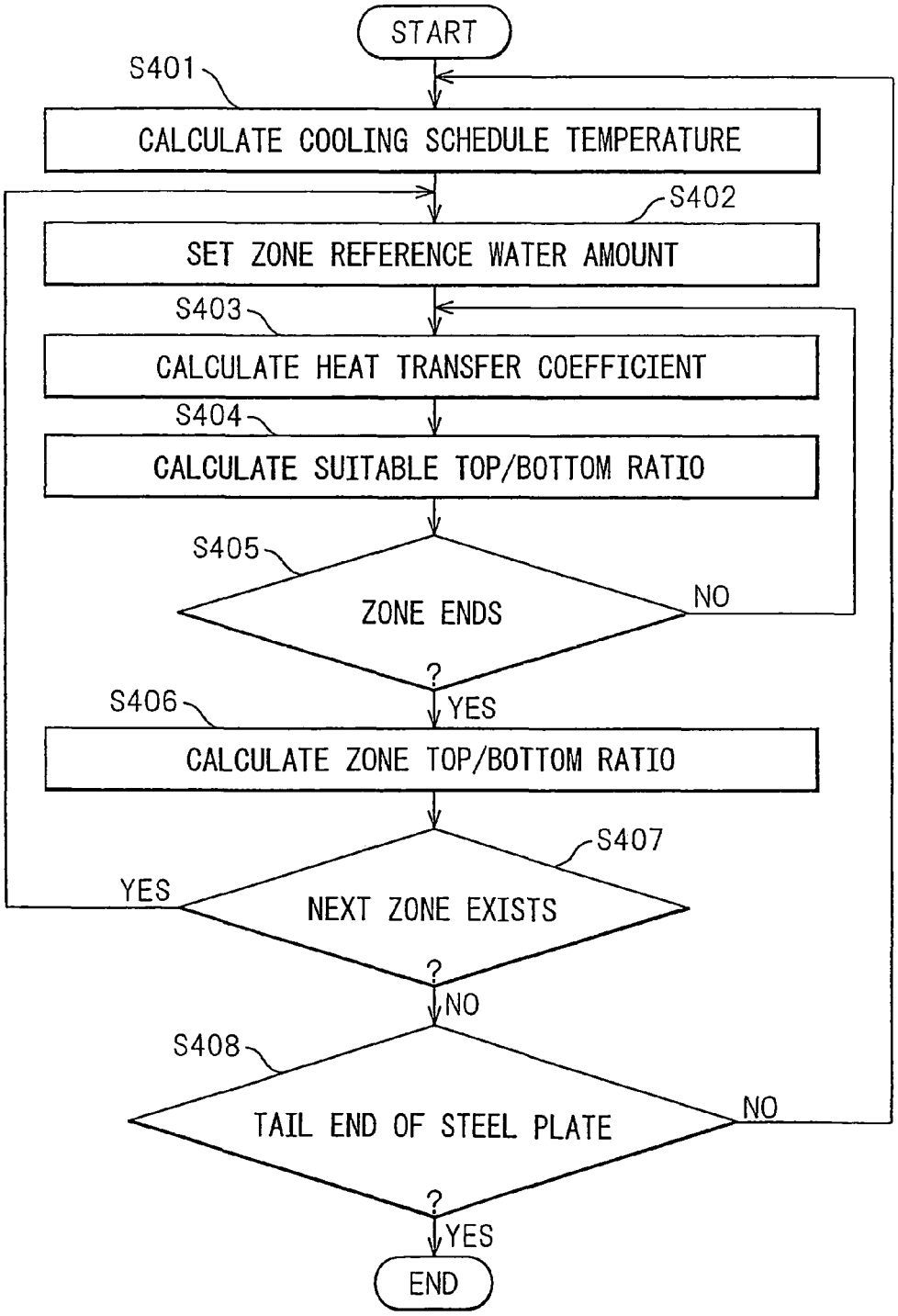
FIG. 4 is a flow chart showing an example of the routine for determining the amounts of cooling water by a cooling water amount calculation apparatus of the first embodiment of the present invention.

FIG. 4 is a flow chart showing an example of the routine for determining the amounts of cooling water by the cooling water amount calculation apparatus 100 in the present embodiment.

At step S401, the cooling schedule setting unit 101 sets the cooling schedule of the steel plate 1 by the cooling apparatus 4. Specifically, it performs processing for measuring the surface temperature of the steel plate 1 measured by the cooling entry-side thermometer 7 and finding the temperature distribution in the plate thickness direction at each segment at a point of time immediately before cooling.

Figure 7:
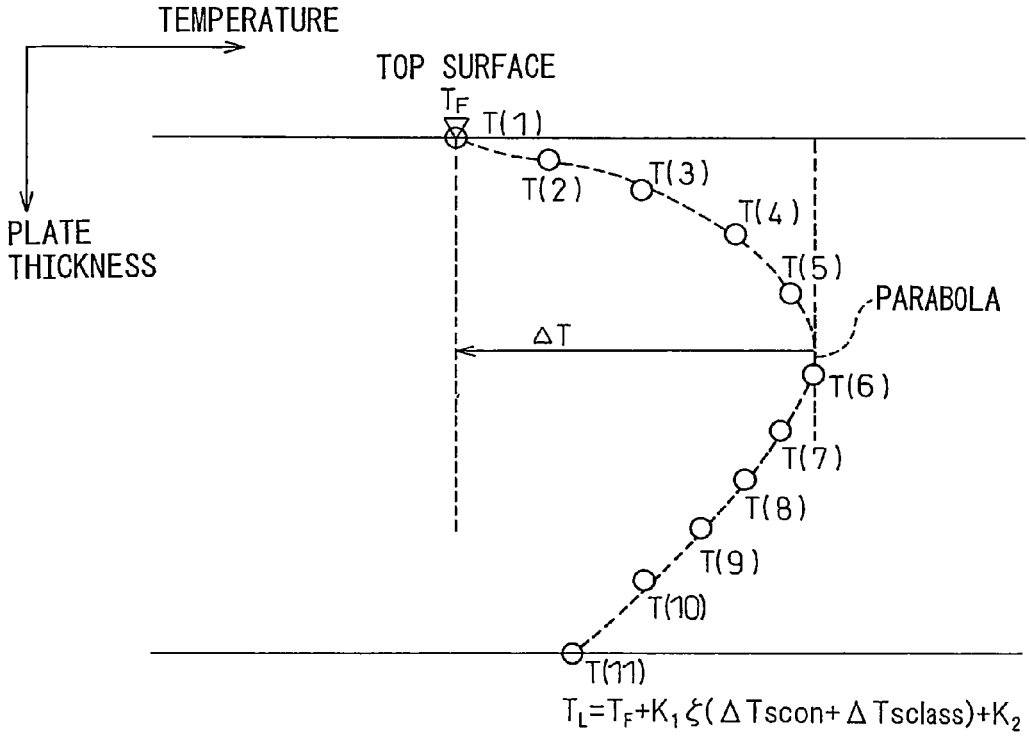
FIG. 7 is a view showing temperature distributions of 11 points in a plate thickness direction.

It is known that the temperature distribution in the plate thickness direction exhibits a parabolic shape where the temperature becomes the highest at a middle position in the plate thickness direction. Further, as the technique for finding the temperature distribution in the plate thickness direction from surface temperatures, for example, it is possible to determine the temperature distribution of 11 points in the plate thickness direction by using the technique disclosed in Japanese Patent Publication (B2) No. 7-41303 (see FIG. 7). Explaining this in brief, the top surface temperature $T_F$ is the measured temperature. The temperature difference ΔT between the top surface and the highest point of plate temperature is given by the following equation (1):

$$\Delta T=33.8-3.63h(-0.0371+0.00528h)\cdot TF \quad (1)$$

where

ΔT: temperature difference between top surface and highest point of plate temperature, and h: plate thickness.

The bottom surface temperature $T_L$ is given by the following equation (2):

$$T_L=T_F+K_1\xi(\Delta T_S\text{con}+\Delta T_S\text{class})+K_2 \quad (2)$$

where,

ξ: temperature transform coefficient obtained by learning, $\Delta T_S$: entry-side temperature top/bottom surface temperature difference obtained by learning, and $K_1$, $K_2$: adjustment elements.

The parabolic temperature distribution satisfying the above conditions is determined, and the temperature distribution in the plate thickness direction is determined.

Further, by using the temperature distribution of the plate thickness direction of each segment at the time right before the cooling, dividing the above plate thickness direction into suitable lengths based on the desired control precision (for example, 11 points) for use as points for calculation, and analyzing the trends in temperature until the cooling start position of the cooling apparatus 4 by solving the difference equation of heat conduction, the average temperature Tsk* in the plate thickness direction at the different segments at the cooling start position of the cooling apparatus 4 (hereinafter referred to as the "cooling start temperature Tsk*", k being a thickness direction index) is calculated as the cooling start temperature information. Regarding the technique for analyzing the trends in temperature by solving the difference equation of heat conduction, as disclosed in for example Japanese Patent Publication (B2) No. 7-41303, the primary difference equation of heat conduction shown in the following equation (3) is solved based on the initial temperature distribution state of the plate thickness direction using 11 points in the representative points on the plate as calculation points:

$$Q(j)_t+\Delta t=Q(j)_t+\Delta t\cdot(\lambda_{j+1}-2\lambda_j+\lambda_{j-1})/\rho\cdot\Delta x^2 \quad (3)$$

$$(j=1 \text{ to } 11) \text{ and}$$

$$\Delta Qs=4.88[[(Tg+273)/100]^4-[(T(j)+273)/100]^4]$$

$$(j=1, 11)=0(j=2 \text{ to } 10)$$

where, $Q(j)_t$: heat content of element i at time t, $T(j)_t$: temperature indication, Δt: time increments when calculating difference (=const, 150 msec), ρ: density, λ: thermal conductivity of element i, Tg: gas temperature, $\Delta Q_s$: boundary condition, Δx: plate thickness divided thickness In this case, the plate temperature T is converted to the heat content Q by, when T>880, Q=3.333+0.16T when T≤880, $Q=-149.05+0.481\cdot T-1.68\times10^{-4}\cdot T^2$ and the heat content Q is converted to temperature T (heat content: value obtained by integrating specific heat from 0° C. to T) by, when Q>144.13, T=−20.8+6.25×Q when 0<Q≤144.13, T=1431.5−√(1.162×$10_6$−5.95×$10^3$×Q)

Figure 10:
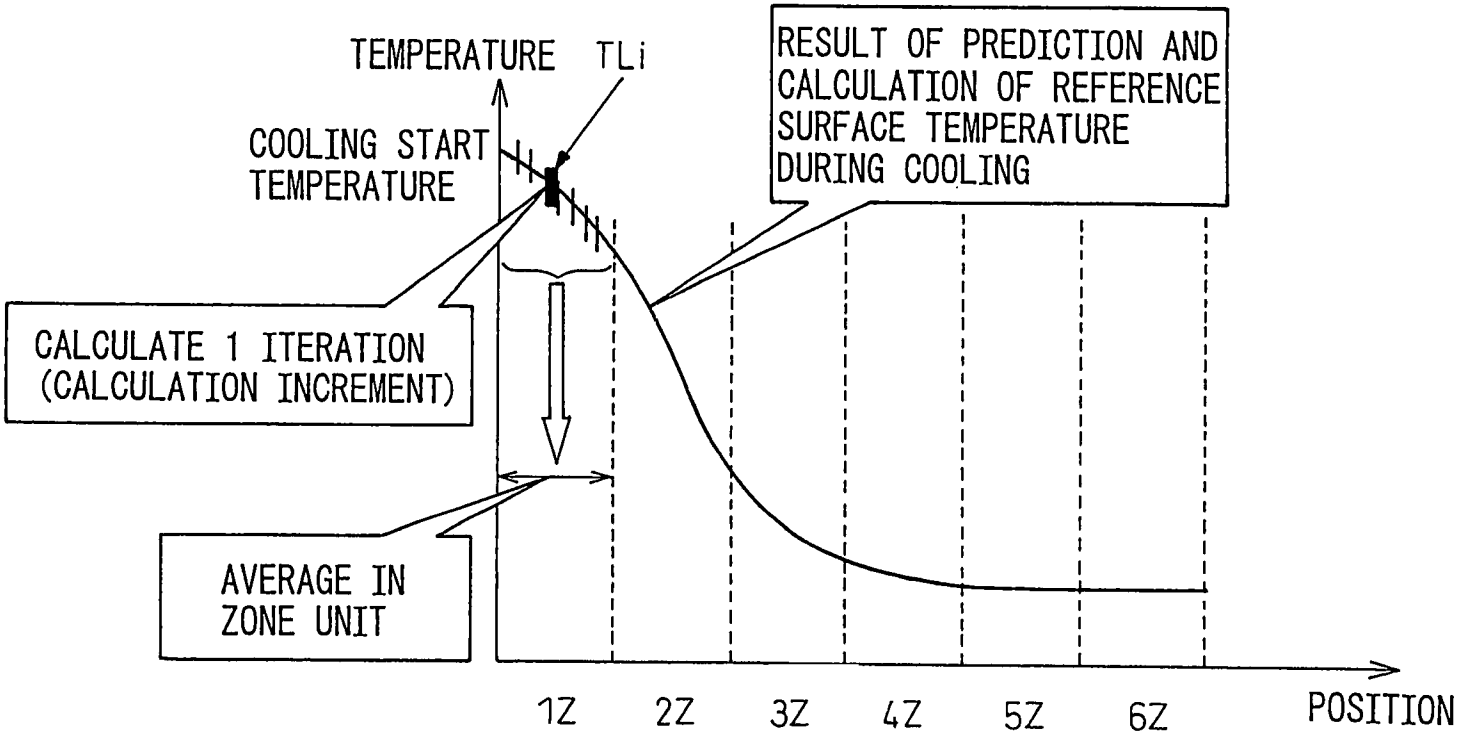
FIG. 10 is a graph showing an example of the trend in the cooling temperature in the first embodiment of the present invention.

Further, the cooling schedule setting unit 101 calculates and sets the passage times (TMz) and cooling prediction temperatures (Tsk) in the zones based on the cooling plate threading speeds in the zones (1Z to 19Z). Here, the cooling prediction temperature (Tsk), as shown in FIG. 10, shows the entry-side temperature in one of the divided areas in each zone.

Figure 8:
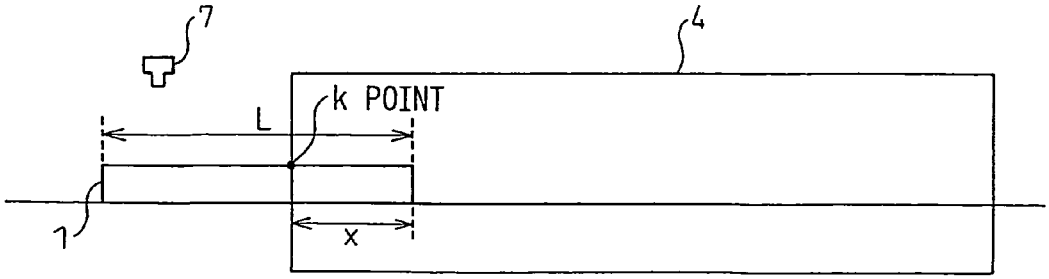
FIG. 8 is a view showing a position of the steel plate passing through the cooling apparatus.

The cooling plate threading speed is given by a set of the position of the front end of the plate and the data of the conveyance speed by the method disclosed in Japanese Patent Publication (B2) No. 7-41303. As shown in FIG. 8, when the position of the front end of the plate is defined as x and the conveyance speed at this time is V(x), the water cooling time of the k point on the plate at the entry of the cooling apparatus at that point of time, in other words, a point existing later than the front end of the plate by x is given by:

$$t(x)\int_{x}^{x-Lzone}\frac{1}{V(x)}\,dx \tag{1}$$

Next, the water cooling times $t_t$, $t_m$, and $t_b$ at the front end, center, and tail end are found by the following equations:

$$t_t\int_{x}^{Lzone}\frac{1}{V(x)}\,dx \tag{2}$$

$$t_m\int_{0}^{L/2+lzone}\frac{1}{V(x)}\,dx \tag{3}$$

$$t_b\int_{0}^{L+lc}\frac{1}{V(x)}\,dx \tag{4}$$

L: plate length, V(x)=1/(ax²+bx+c), and a, b, and c are found by entering these into above three equations.

$$a=\frac{1}{L^2\cdot lzone^2}(t_t+t_b-2t_m) \tag{5}$$

$$b=\frac{1}{L^2\cdot lzone^2}\left\{L\left(2t_m-\frac{3t_t+t_b}{2}\right)+lzone(t_t+t_b-2t_m)\right. \tag{6}$$

$$c=\frac{1}{L^2\cdot lzone^2}\left\{L^2t_t+lzone\cdot L\left(\frac{3t_t+t_b-t_m}{4}\right)+lc^2\left(\frac{t_t+t_b}{6}-\frac{T_m}{3}\right)\right\} \tag{7}$$

The acceleration range (definition area of x) is found as in the following equation:

$$0\le x\le L+|zone+\Delta|c_2,$$

L: plate length, |zone: effective cooling zone length, $\Delta|c_2$: excess margin (=const)

By the above, x is suitably determined within a determined acceleration range and entered into the formula of V(x) to prepare a set of the position of the front end of the steel plate and the conveyance at that point of time (speed pattern). Then, the results of the calculation are output to the threading speed control apparatus (not shown).

The acceleration ratio is found in this way because the steel plate 1 is cooled while being conveyed, so the timings of entering to the cooling apparatus 4 differ between the front end and tail end of the steel plate. Namely, the cooling start temperature differs along the longitudinal direction of the steel plate, therefore the temperature after cooling ends up becoming different between the front end and the tail end. To make the quality of the product uniform over the entire length, the threading speed is made faster the more toward the tail end so as to eliminate the difference. The cooling schedule up to the cooling end target temperature is acquired due to the above.

Next, at step S402, the heat transfer coefficient calculation unit 102 selects a reference water density corresponding to the zone Z being calculated from the zone reference water densities and enters it into the cooling lower water density (WDLi). Here, as the method of determining the reference water density of each zone, as shown in for example Japanese Patent Publication (B2) No. 7-41303, use can be made of for example the method of determining the reference water density according to the value transmitted from a business computer.

Next, at step S403, the heat transfer coefficient calculation unit 102 calculates the difference of heat conduction using the cooling prediction temperature (Tsk) as the initial value and calculates the steel plate bottom surface temperature (TLi). Here, the value of Tsk in a first iteration calculation in the zone 1Z is the "cooling start temperature Tsk*". Otherwise, the results of iteration calculation become Tsk. Further, the lower heat transfer coefficient (aLi) is found from the calculated cooling lower water density (WDLi) and the steel plate bottom surface temperature (TLi). The steel plate bottom surface temperature (TLi) can be calculated as j=11 when taking as an example Japanese Patent Publication (B2) No. 7-41303 explained before.

FIG. 10 is a graph showing the trends in the cooling temperature in the present embodiment.

As shown in FIG. 10, the steel plate bottom surface temperature (TLi) indicates for example the entry-side bottom surface temperature in 1 iteration in the zone 1Z. When calculating the steel plate bottom surface temperature (TLi), the difference of heat conduction is calculated by using the cooling prediction temperature (Tsk) as the initial value. The steel plate bottom surface temperature (TLi) is calculated in each iteration.

The method for calculating the lower heat transfer coefficient (aLi) will be explained in detail with reference to FIG. 5.

The heat transfer coefficient (a) is generally a nonlinear function determined by the water density WD ($m^3/(m^2\cdot min)$) and the surface temperature Ts. A variety of equations are proposed. For example, the following equation is proposed:

$$\mathrm{Log}(a)=A+B^*\mathrm{Log}(\mathrm{WD})+C^*\mathrm{Ts}+D. \tag{4}$$

The heat transfer coefficient (a) differs according to the difference in the form of boiling of the water, therefore, Equation (4) is generally subjected to coefficient division by surface temperature as follows for the coefficients A, B, C, and D in Equation (4):

Ts≥K1→A1, B1, C1, D1,

Ts<K1→A2, B2, C2, D2.

Further, there is generally a difference in the pooled states of the cooling water between the top surface and the bottom surface, therefore coefficient division is usual. Accordingly, in the example employing the basic equation (4), the heat transfer coefficient is calculated by selective use of the following coefficient sets. For example, for the coefficients for calculation of the upper heat transfer coefficients, the following are used:

$$Ts_U \geq K1_U \rightarrow A1_U, B1_U, C1_U, D1_U \text{ and}$$

$$Ts_U < K1_U \rightarrow A2_U, B2_U, C2_U, D2_U$$

Further, for the coefficients for calculation of the lower heat transfer coefficients, the following are used:

$$Ts_L \geq K1_L \rightarrow A1_L, B1_L, C1_L, D1_L \text{ and}$$

$$Ts_L < K1_L \rightarrow A2_L, B2_L, C2_L, D2_L$$

An explanation will be given on FIG. 5 based on the above thinking.

Figure 5:
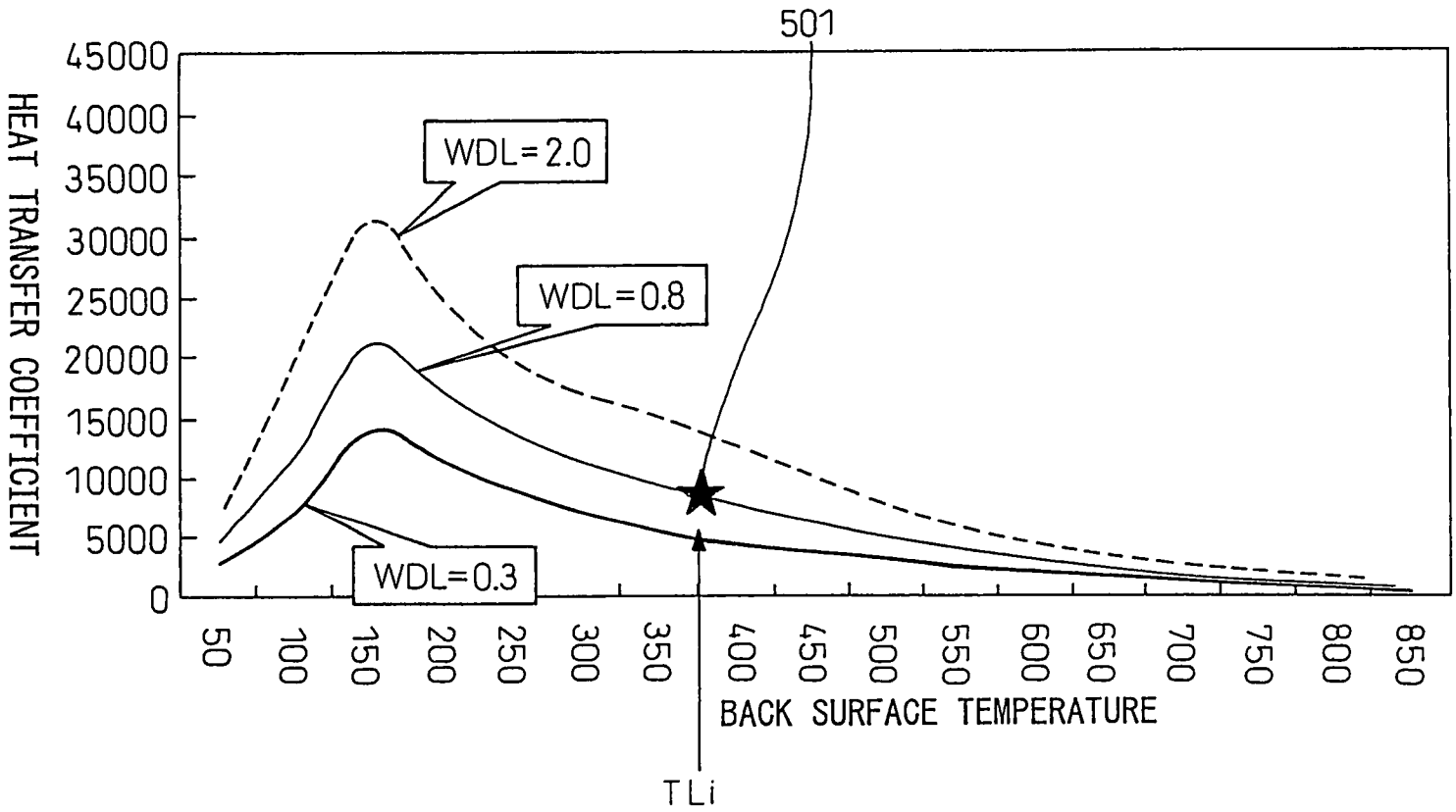
FIG. 5 is a view showing the relationship between a steel plate bottom surface temperature and a lower heat transfer coefficient in the first embodiment of the present invention.

FIG. 5 is a graph showing the relationship between the steel plate bottom surface temperature and the lower heat transfer coefficient in the present embodiment.

FIG. 5 show curves showing relationships between the steel plate bottom surface temperature and the heat transfer coefficient in cases where WDLi=0.3, 0.8, and 2.0.

For example, when WDLi=0.8, if the value of the steel plate bottom surface temperature (TLi) is calculated, the Y component (aLi) at the coordinates 501 on the curve corresponding to WDLi=0.8 can be found. Note that a plurality of curve patterns differing according to the numerical values of the cooling lower water density (WDLi) are stored in advance. When the curve pattern of the calculated cooling lower water density (WDLi) is not stored, the calculation is carried out by using a curve pattern having the nearest numerical value. Accordingly, in order to raise the calculation precision, desirably many curve patterns are stored.

Next, at step S404, the top/bottom ratio calculation unit 103 calculates the cooling upper water density (WDUi) by using the lower heat transfer coefficient (aLi) calculated at step S403 and calculates the suitable top/bottom ratio (ηi) in the iteration.

Figure 6:
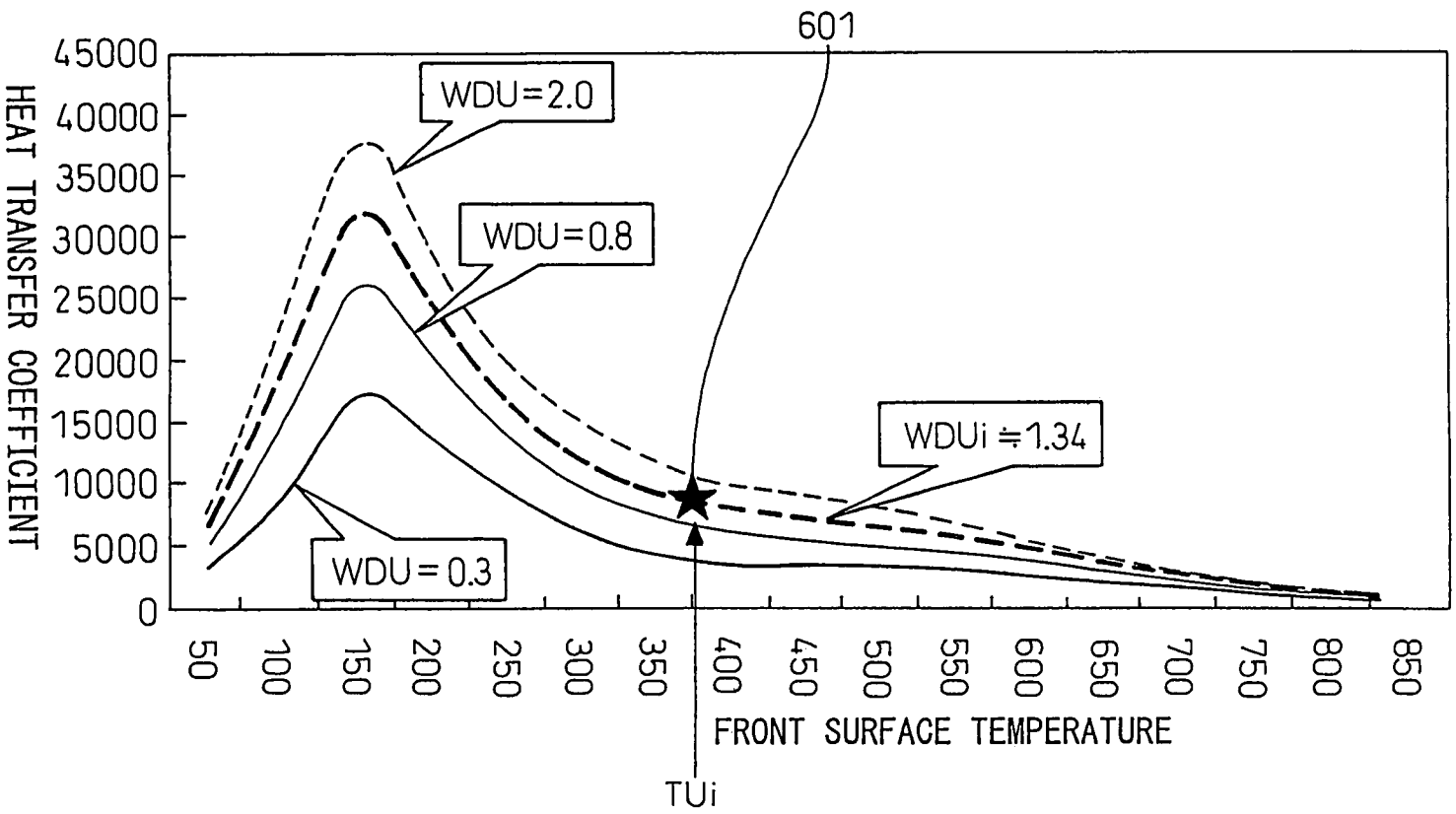
FIG. 6 is a view showing the relationship between a steel plate top surface temperature and a upper heat transfer coefficient in the first embodiment of the present invention.

Next, the method of calculating the cooling upper water density (WDUi) with reference to FIG. 6.

FIG. 6 is a view showing the relationship between the steel plate top surface temperature (TUi) and the upper heat transfer coefficient (aUi) in the present embodiment.

In the present embodiment, a curve passing through the coordinates 601 where the steel plate top surface temperature (TUi)=steel plate bottom surface temperature (TLi) and the upper heat transfer coefficient (aUi)=the lower heat transfer coefficient (aLi) stand is searched for and the cooling upper water density (WDUi) is obtained. In the same way as the curve pattern of the cooling lower water density (WDLi), a plurality of curve patterns of the cooling upper water density (WDUi) are stored as well, but when the corresponding curve pattern is not stored, the cooling upper water density (WDUi) is directly calculated.

Next, the method of calculation of the cooling upper water density (WDUi) will be explained with reference to FIG. 9 and FIG. 11.

Figure 9:
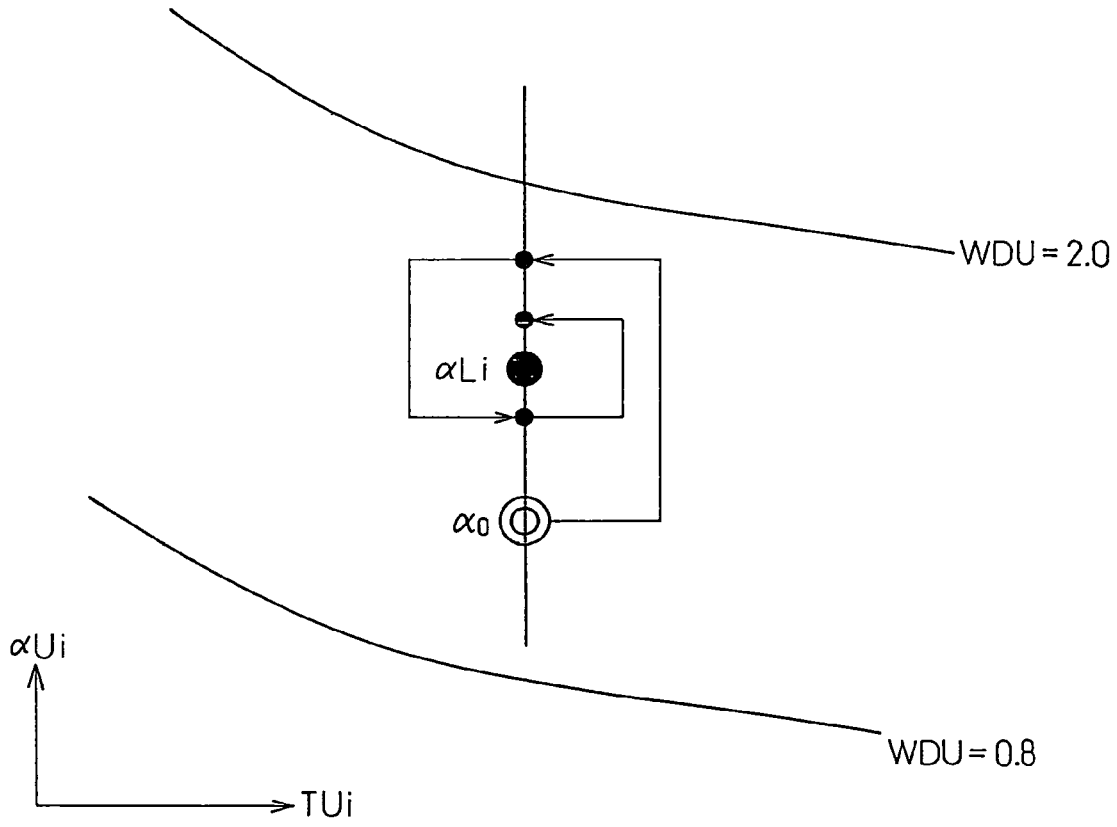
FIG. 9 is a view showing a method of searching for a cooling top water density in the first embodiment of the present invention.

FIG. 9 is a view showing a method of searching for the cooling upper water density (WDUi) in the present embodiment.

As shown in FIG. 9, the cooling upper water density (WDUi) with which the upper heat transfer coefficient (aUi) becomes the same as the lower heat transfer coefficient (aLi) is searched for and calculated while changing the cooling water density WDU.

Figure 11:
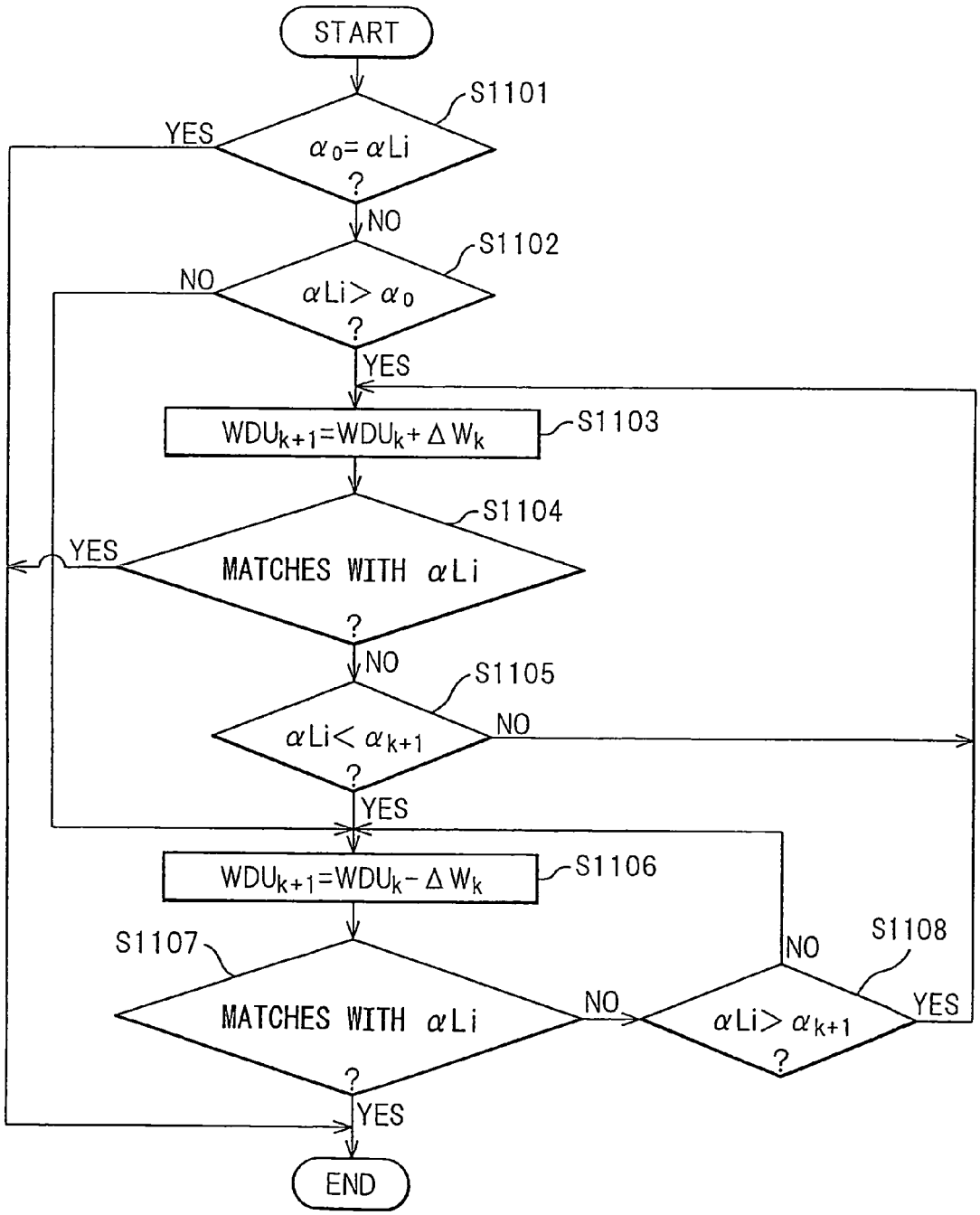
FIG. 11 is a flow chart showing an example of the routine by which a top/bottom ratio calculation unit calculates a cooling top water density of the first embodiment of the present invention.

FIG. 11 is a flow chart showing the routine for calculating the cooling upper water density (WDUi) by the top/bottom ratio calculation unit 103.

At step S1101, it is judged whether or not the upper standard heat transfer coefficient ($a_0$) matches with the lower heat transfer coefficient (aLi). Here, the upper standard heat transfer coefficient ($a_0$) is a non-reference surface heat transfer coefficient corresponding to the standard water density (WDU*) and is calculated by Equation (4). Further, the standard water density (WDU*) is stored in advance as data.

When result of this judgment is that they match, WDUi=WDU* and the calculation ends. On the other hand, when the result of judgment at step S1101 is that they do not match, at step S1102, it is judged whether or not the upper standard heat transfer coefficient ($a_0$) is larger than the lower heat transfer coefficient (aLi). When the result of this judgment is that the upper standard heat transfer coefficient ($a_0$) is larger than the lower heat transfer coefficient (aLi), the routine jumps to step S1106. On the other hand, when the result of judgment of step S1102 is that the upper standard heat transfer coefficient ($a_0$) is smaller than the lower heat transfer coefficient (aLi), the routine proceeds to step S1103.

Next, at step S1103, 1 is added to k (k=0 when the routine proceeds from step ST1102), and $WDU_{k+1}=WDU_k+\Delta W_k$ ($k \geq 0$) is calculated. Here, $WDU_k$ and $\Delta W_k$ are defined as follows:

$$\Delta W_k = |WDU_k - WDU_{k-1}|/2 \ (k \geq 1), \text{ and}$$

$$WDU_0 = WDU^*, \ \Delta W_0 = S \ (S\text{: constant})$$

Next, at step S1104, it is judged whether or not the heat transfer coefficient ($a_{k+1}$) corresponding to $WDU_{k+1}$ calculated at step S1103 matches with the lower heat transfer coefficient (aLi). When the result of this judgment is that they match, WDUi=$WDU_{k+i}$, and the calculation ends. On the other hand, when the result of the judgment of step S1104 is that they do not match, it is judged at step S1105 whether or not the above calculated heat transfer coefficient ($a_{k+1}$) is larger than the lower heat transfer coefficient (aLi).

When the result of this judgment is that the above calculated heat transfer coefficient ($a_{k+i}$) is smaller than the lower heat transfer coefficient (aLi), the routine returns to step S1103, where 1 is added to k, then the calculation is carried out in the same way again. On the other hand, when the result of the judgment of step S1105 is that the above ($a_{k+}1$) is larger than the above (aLi), the routine proceeds to step S1106.

Next, at step S1106, 1 is added to k (k=0 where the routine proceeds from step S1102), and $WDU_{k+1}=WDU_k-\Delta W_k$ ($k \geq 0$) is calculated. Then, at step S1107, it is judged whether or not the heat transfer coefficient ($a_{k+1}$) corresponding to $WDU_{k+1}$ calculated at step S1106 matches with aLi. When the result of this judgment is that they match, WDUi=$WDU_{k+1}$, and the calculation ends. On the other hand, when the result of the judgment of step S1107 is that they do not match, at step S1108, it is judged whether or not $a_{k+1}$ is smaller than aLi.

When the result of this judgment is that the above calculated heat transfer coefficient ($a_{k+1}$) is larger than the above lower heat transfer coefficient (aLi), the routine returns to step S1106, where 1 is added to the value k, and the calculation is carried out in the same way again. On the other hand, when the result of the judgment of step S1108 is that the above ($a_{k+1}$) is smaller than the above (aLi), the routine proceeds to step S1103, where 1 is added to the value k, and the calculation is carried out in the same way again. As described above, the calculation is repeatedly carried out until the above calculated heat transfer coefficient ($a_{k+1}$) matches with the lower heat transfer coefficient (aLi).

Note that, in the present embodiment, when starting the cooling at the cooling apparatus 4, it is assumed that the steel plate top surface temperature and the steel plate bottom surface temperature become almost the same and the calculation is carried out regarding the steel plate top surface temperature (TUi)=steel plate bottom surface temperature (TLi). However, for example, at the stage before the cooling by the cooling apparatus 4, sometimes a difference occurs between the steel plate top surface temperature and the steel plate bottom surface temperature by calculating the difference equation of heat conduction. In this case, for the zone 1Z, the difference equation of heat conduction may be calculated while defining j=1. The thus calculated numerical value may be referred to later for fine adjustment.

Then, by calculating the cooling upper water density (WDUi), the suitable top/bottom ratio of the iteration is calculated. The suitable top/bottom ratio (ηi) becomes ηi=WDUi/WDLi.

Next, at step S405, the top/bottom ratio calculation unit 103 judges whether or not all of iterations end for one zone. When the result of this judgment is that they have not ended, the routine returns to step S403, where the calculation is repeated again. On the other hand, when the result of the judgment of step S405 is that the iterations end, the routine proceeds to the next step S406.

The number of iterations may be freely set, but the number of iterations is determined so that ETM≥TMz always stands when multiplying the number of iterations (I) by 1 iteration time (TM*) to calculate the elapsed time (ETM).

Next, at step S406, the top/bottom ratio calculation unit 103 calculates an average value (AVE(ηi)) of the suitable top/bottom ratios (ηi) of the iterations and finally defines that average value as the suitable zone top/bottom ratio (ηz).

Next, at step S407, the heat transfer coefficient calculation unit 102 judges whether or not there is a next zone not calculated. When the result of this judgment is that there is a next zone, the routine returns to step S402, where the calculation is carried out again in order to calculate the suitable zone top/bottom ratio (ηi) for the next zone. On the other hand, when the result of the judgment of step S407 is that there is no next zone, the routine proceeds to the next step S408.

When the calculation of all of the suitable zone top/bottom ratios ends, the cooling water amount calculation apparatus 100 transmits the data of all suitable zone top/bottom ratios (ηz) to the cooling water amount control apparatus 500, and the cooling water amount control apparatus 500 adjusts the flow rate control valves 501 of the cooling apparatus 4 based on that data and runs cooling water to the nozzles. Due to this, in the present embodiment, cooling water in all zones can be made to flow before the front end of the steel plate 1 enters the cooling apparatus 4.

At step S408, the cooling schedule setting unit 101 judges whether or not the portion measured for temperature by the cooling entry-side thermometer 7 was the front end of the steel plate 1. When the result of this judgment is that the measured portion was the tail end of the steel plate, all processing is ended. On the other hand, when result of the judgment of step S408 is that the measured portion was not the tail end of the steel plate 1, the routine returns to step S401, where the cooling schedule is newly acquired for the next portion in the steel plate 1.

As explained before, the plate threading speed is made faster toward the tail end in order to make the product quality of the steel plate 1 uniform over the entire length. For this reason, the cooling schedule of the steel plate 1 differs according to the position of the steel plate 1. Accordingly, in the present embodiment, the steel plate 1 is divided into a plurality of portions and the cooling schedule is acquired for each portion.

In the present embodiment, the cooling upper water density (WDUi) and the cooling lower water density (WDLi) are determined as explained before, therefore, in order to cool the steel plate 1 to the previously determined cooling end temperature, the calculation amount required for controlling the amounts of cooling waters sprayed from the top and bottom surfaces of the cooling apparatus 4 can be simplified. Due to this, cooling water can be run in all zones 1Z to 19Z before the front end of the steel plate 1 enters to the cooling apparatus 4, and the deterioration of the steel plate shape can be suppressed to the smallest limit.

Other Embodiments

The cooling water amount calculation apparatus 100 of the embodiment explained before is specifically configured by a computer apparatus or a computer system including a CPU, RAM, ROM, etc. Therefore, the computer program itself installed in a computer to realize the functional processing of the present invention is also included in the present invention.

Further, the above embodiments only show specific examples of working the present invention. They should not be used to interpret the technical scope of the present invention in a limited manner. That is, the present invention may be carried out in various ways without departing from its technical idea and main features.

The invention claimed is:

1. A method of cooling control for cooling a steel plate by a cooling apparatus with cooling water immediately after rolling, wherein the steel plate comprises a first surface and a second surface, wherein the first surface and the second surface are on opposite sides of the steel plate, the method comprising:

a cooling schedule setting step of setting a cooling schedule required for cooling said steel plate to a predetermined temperature for a plurality of positions along a length of said steel plate inside said cooling apparatus, wherein the cooling schedule setting step includes measuring a temperature of the first or second surface of said steel plate by a thermometer disposed at an entry-side of said cooling apparatus, and calculating temperatures of said steel plate at the plurality of positions at a time when said steel plate passes through said cooling apparatus based on the temperature of the first or second surface;

a heat transfer coefficient calculation step of calculating a first heat transfer coefficient of the first surface of said steel plate and a first surface temperature of said first surface based on the temperature in the cooling schedule set by said cooling schedule setting step and a first cooling water density for cooling said first surface of said steel plate;

a ratio calculation step of calculating a ratio between said first cooling water density and a second cooling water density in relation to each of the plurality of positions along the length of said steel plate, wherein the ratio calculation step comprises:

obtaining a function of a second heat transfer coefficient, a second surface temperature and the second cooling water density for the second surface of said steel plate, and storing the function;

setting said second heat transfer coefficient of said second surface equal to said first heat transfer coefficient;

determining the second cooling water density for cooling said second surface based on the stored function and said set second heat transfer coefficient, in relation to each of the plurality of positions along the length of said steel plate, so that said second surface temperature is equal to said first surface temperature; and calculating a ratio between said first cooling water density and said second cooling water density in relation to each of the plurality of positions along the length of said steel plate; and a cooling water amount controlling step of controlling the amounts of cooling water for cooling said steel plate passing through said cooling apparatus based on the ratio calculated by said ratio calculation step.

2. The method of cooling control as set forth in claim 1, wherein:

said first cooling water density is the cooling water density of the cooling water for cooling a bottom surface of said steel plate, and said second cooling water density is the cooling water density of the cooling water for cooling the top surface of said steel plate.

3. The method of cooling control as set forth in claim 1, wherein said first cooling water density is determined based on the cooling schedule set by said cooling schedule setting step.

4. A computer system comprising a computer and a computer program encoded therein, said computer system characterized in that the computer is made to execute the method of cooling control of claim 1.

5. A computer program product comprising a storage medium readable by a computer and a computer program encoded therein, said computer program being adapted to be executed by a computer to carry out the method of cooling control of claim 1.

6. The method of cooling control as set forth in claim 1, wherein in said heat transfer coefficient calculation step, said first heat transfer coefficient is determined using stored heat transfer coefficient as a function of steel plate surface temperature and cooling water density for said first surface of said steel plate.

7. The method of cooling control as set forth in claim 1, wherein said heat transfer coefficient calculation step comprises selecting said first cooling water density, by selecting a reference water density that corresponds to a zone to be calculated, from predetermined zone reference water densities.

8. The method of cooling control as set forth in claim 1, wherein said second cooling water density is determined without carrying out a first-dimensional heat-transfer difference calculation on the second surface.

* * * * *